US008288956B1

(12) United States Patent
Xiong et al.

(10) Patent No.: US 8,288,956 B1
(45) Date of Patent: Oct. 16, 2012

(54) LAMP PREHEAT CIRCUIT FOR A PROGRAM START BALLAST WITH FILAMENT VOLTAGE CUT-BACK IN STEADY STATE

(75) Inventors: Wei Xiong, Madison, AL (US); Thomas Lunn, Hazel Green, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 376 days.

(21) Appl. No.: 12/753,392

(22) Filed: Apr. 2, 2010

Related U.S. Application Data

(60) Provisional application No. 61/166,068, filed on Apr. 2, 2009.

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 41/16*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/244; 315/307; 315/DIG. 7; 315/105; 313/364; 336/182

(58) Field of Classification Search ..... 315/94, 315/99, 141, 173, 177, 187, 227 R, 238, 244, 315/235, 291, 353–355, DIG. 7, DIG. 5; 313/364; 336/182

See application file for complete search history.

(56) References Cited

U.S. PATENT DOCUMENTS

| | | | | |
|---|---|---|---|---|
| 4,484,108 | A | 11/1984 | Stupp et al. | |
| 4,523,131 | A | 6/1985 | Zansky | |
| 4,692,667 | A | 9/1987 | Nilssen | |
| 5,289,084 | A | 2/1994 | Nuckolls et al. | |
| 5,877,592 | A | 3/1999 | Hesterman et al. | |
| 5,920,155 | A * | 7/1999 | Kanda et al. | 315/307 |
| 6,037,722 | A | 3/2000 | Moisin | |
| 6,339,298 | B1 | 1/2002 | Chen | |
| 6,452,344 | B1 | 9/2002 | MacAdam et al. | |
| 6,459,214 | B1 | 10/2002 | Chen et al. | |
| 6,501,225 | B1 | 12/2002 | Konopka | |
| 6,900,599 | B2 | 5/2005 | Ribarich | |
| 6,933,684 | B2 | 8/2005 | Yang et al. | |
| 7,176,639 | B2 | 2/2007 | Hu et al. | |
| 7,239,094 | B2 | 7/2007 | Radzinski et al. | |
| 7,372,215 | B2 | 5/2008 | Sekine et al. | |
| 7,394,208 | B2 | 7/2008 | Ribarich et al. | |
| 2008/0067950 | A1 | 3/2008 | Yu et al. | |

* cited by examiner

*Primary Examiner* — Jacob Y Choi
*Assistant Examiner* — Henry Luong
(74) *Attorney, Agent, or Firm* — Waddey & Patterson, P.C.; Mark J. Patterson

(57) ABSTRACT

A circuit for preheating filaments in lamps powered by an electronic ballast includes an inverter tank circuit and a preheat tank circuit. The preheat tank circuit has a preheat capacitor connected in parallel with a primary winding of a filament preheat transformer. A cut-back capacitor is connected between the preheat tank circuit and circuit ground. The filament preheat transformer has secondary windings coupled to the first and second lamp terminals to provide a filament preheat voltage. The inverter operates at a preheat frequency during a lamp preheat mode and at a steady-state frequency during a lamp steady-state mode, the steady-state frequency being lower than the preheat frequency. The preheat tank circuit has a natural resonant frequency that is approximately the same as the preheat frequency so that when the ballast is operating in the steady state mode, the filament voltage is substantially lower than when the ballast is operating in the preheat mode.

8 Claims, 2 Drawing Sheets

LAMP PREHEAT CIRCUIT FOR A PROGRAM START BALLAST WITH FILAMENT VOLTAGE CUT-BACK IN STEADY STATE

CROSS-REFERENCES TO RELATED APPLICATIONS

This application claims benefit of the following patent application(s) which is/are hereby incorporated by reference: U.S. Provisional Patent Application No. 61/166,068, filed Apr. 2, 2009.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic ballasts for powering with gas discharge lamps. More particularly, this invention pertains to circuits for providing effective lamp preheating and steady-state operation using a program-start electronic ballast to power fluorescent lamps.

Conventional electronic ballasts used with fluorescent lamps typically employ inverters operating at frequencies above 20,000 Hz. This high frequency powers the lamps more efficiently and eliminates the 60-cycle hum and visible flicker often associated with electromagnetic ballasts. Electronic ballasts are designed with different lamp starting methods and circuits. The most common types are instant-start, rapid-start, and program-start.

Instant-start electronic ballasts are popular because they provide energy savings and can start lamps without delay or flashing. Because instant-start ballasts do not provide lamp filament heating, they can consume less energy compared to rapid-start or program-start ballasts. Instant-start electronic ballasts provide a high initial voltage to start the lamp. This high voltage is required to initiate discharge between the unheated electrodes of the lamp. However, cold electrodes of lamps operated by an instant-start ballast may deteriorate more quickly than pre-heated electrodes of lamps operated by a rapid-start or program-start ballast.

A typical rapid-start ballast may use a separate set of windings to provide a low voltage to the lamp electrodes prior to lamp ignition. A starting voltage somewhat lower than that of an instant-start ballast is applied to strike an electrical arc inside the lamp. Many rapid-start electronic ballasts continue to heat the lamp electrodes even after the lamp has started, which results in a power loss.

Program-start electronic ballasts can provide maximum lamp life under frequent starting conditions. A typical program-start ballast will use circuitry and/or logic to monitor lamp and ballast conditions to ensure optimal system lighting performance. Program-start ballasts will also include circuitry to precisely preheat the lamp filaments before lamp ignition, in a manner that puts the least amount of stress on the lamp electrodes. This can maximize lamp life regardless of the number of lamp starts.

One of the problems associated with program-start ballasts is that the preheat circuitry is also functional during steady-state lamp operation. This results in a voltage being applied across the lamp filaments in the steady state when no filament heating is needed.

A half-bridge, class D inverter topology is often used in electronic ballasts because of its low cost and high efficiency. This topology is shown generally in FIG. 1. A bulk DC rail voltage at V_rail is coupled to a pair of inverter switches Q1 and Q2. The gate terminals of the switches can be coupled to an inverter driver circuit (not shown) to cause the switches to provide a high-frequency inverter output voltage at an inverter output The high frequency inverter output voltage is coupled to a series-resonant inverter tank circuit (L_resonant and C_resonant) through a DC blocking capacitor C_dc_block. A gas discharge lamp R_lamp is connected across the resonant capacitor C_resonant.

There are numerous ways to design and implement a program-start ballast based on this half-bridge inverter topology. One simple example used in the prior art is shown in FIG. 2, which shows a program-start ballast powering a pair of series-connected fluorescent lamps Lamp_1 and Lamp_2. Secondary windings (L_resonant_A, L_resonant_B and L_resonant_C) of the resonant inductor L_resonant are used to heat the lamp filaments (R_filament_1*a*, R_filament_1*b*, R_filament_2*a* R_filament_2*ba*.) Current-limiting capacitors C1, C2 and C3 are used to reduce the filament voltage during steady state operation.

Unfortunately, if the lamp impedance is high or if the lamps are connected in series, it is very difficult to find an optimized point to design a preheat circuit to achieve high preheat voltage and low steady state filament voltage. One reason for this is that circuit resonant frequency during steady-state lamp operation is very close to the natural resonant frequency of the resonant inverter tank. Also, the presence of capacitors C1, C2 and C3 will cause an unbalanced lamp pin current during steady-state operation. This can be a serious problem when using T5 28 watt lamps, for example, because these lamps have a very low design limit for pin current.

Because a high filament voltage during steady-state operation reduces the efficiency of the ballast and can cause high pin current problems for some lamps, dedicated filament voltage cutback circuits are sometimes used in program-start ballasts. However, these circuits undesirably increase component count and the cost of the ballast.

What is needed, then, is an efficient and low cost circuit for program-start ballasts that provides effective preheating of the lamp filaments while also providing a low filament voltage during steady-state operation.

BRIEF SUMMARY OF THE INVENTION

In accordance with one aspect of the present invention, a preheat circuit is provided for preheating filaments in lamps powered by an electronic ballast. The ballast has an inverter providing an inverter output voltage at an inverter output. The inverter includes an inverter tank circuit having a resonant inductor coupled at a first end to the inverter output and at a second end to a first lamp terminal and a resonant capacitor coupled between the first lamp terminal and a second lamp terminal.

A preheat tank circuit includes a preheat capacitor connected in parallel with a primary winding of a filament preheat transformer. The preheat tank circuit has a first circuit junction coupled to the first lamp terminal. A cut-back capacitor is connected between a second circuit junction of the preheat tank circuit and the second lamp terminal. The filament preheat transformer also has secondary windings coupled to the first and second lamp terminals to provide a filament voltage to the lamp(s).

The inverter operates at a preheat frequency during a lamp preheat mode and at a steady-state frequency during a lamp steady-state mode. The steady-state frequency is lower than the preheat frequency. The preheat tank circuit is designed to have a natural resonant frequency that is approximately the same as the preheat frequency so that when the ballast is operating in the steady state mode, the filament voltage is substantially lower than when the ballast is operating in the preheat mode.

In another embodiment, the present invention is a ballast circuit for powering a gas discharge lamp. The ballast circuit includes first and second ballast output terminals and an inverter circuit that converts a DC rail voltage into a ballast output voltage across the ballast output terminals. An inverter tank circuit is electrically coupled to the inverter circuit and to the first and second ballast output terminals. A preheat tank circuit is electrically coupled to the first ballast output terminal. A filament transformer has a primary winding and at least first and second secondary windings. The primary winding forms part of the preheat tank circuit and the first and second secondary windings are electrically coupled to the first and second ballast output terminals to provide a lamp filament current. A cut-back capacitor is electrically coupled between the preheat tank circuit and the second ballast output terminal.

The preheat tank circuit further includes resonant circuit components that define a preheat tank resonant frequency. The inverter circuit provides the ballast output voltage at a preheat frequency during a lamp preheat mode and at a steady-state frequency during a lamp steady-state mode, with the preheat frequency being different from the steady-state frequency. The preheat tank resonant frequency is equal to or at least closer to the preheat frequency than to the steady-state frequency so that when the inverter circuit is operating in the steady-state mode, a steady-state voltage is developed across the primary winding in the resonant tank circuit that is lower than a preheat voltage developed across the primary winding when the inverter circuit is operating in the preheat mode.

DETAILED DESCRIPTION OF THE INVENTION

Figure 3:
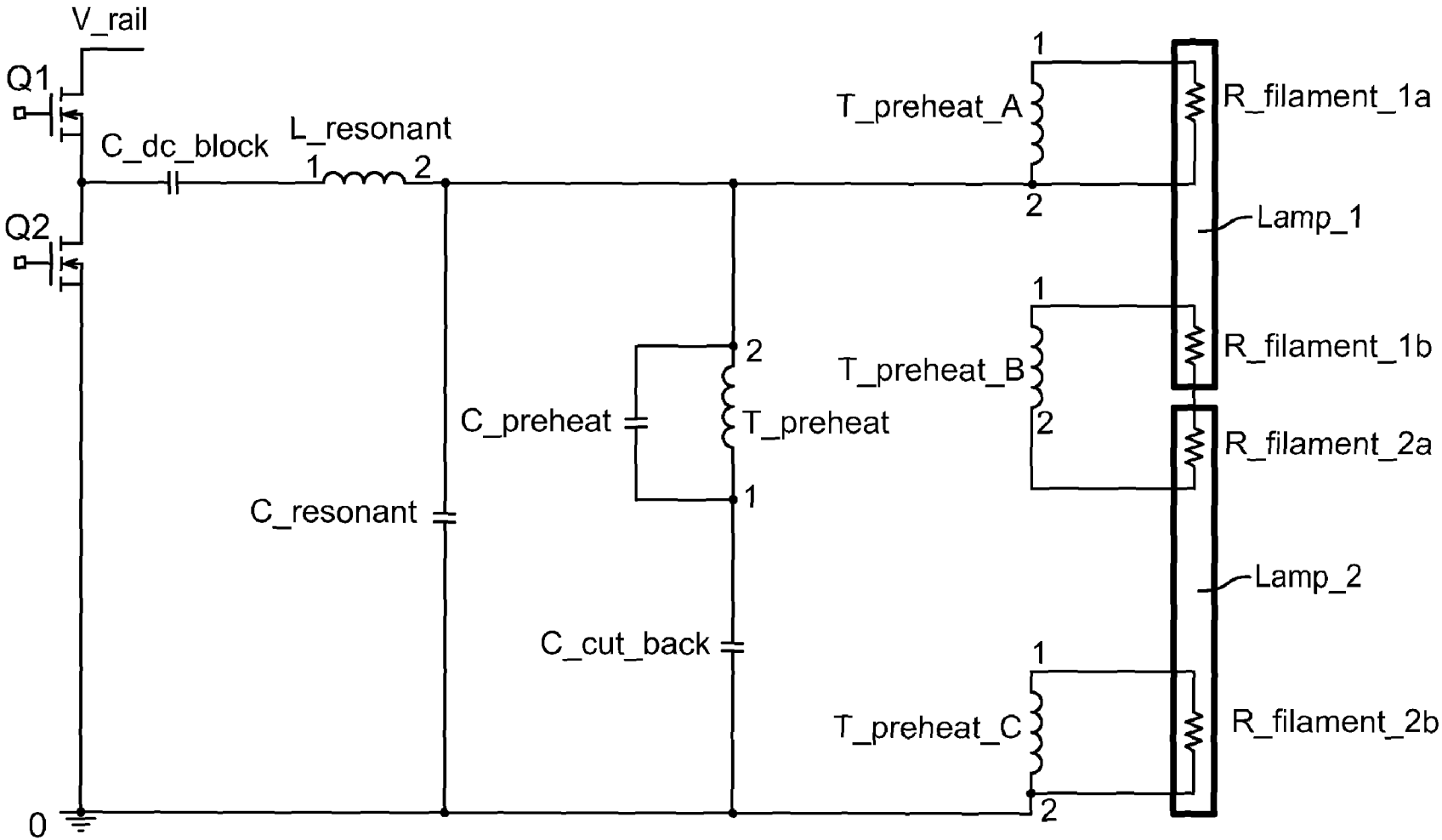
FIG. 3 is a schematic diagram of one embodiment of a lamp preheating circuit in accordance with the present invention.

Referring to FIG. 3, a lamp preheating circuit for use in a program-start electronic ballast is shown. Inverter switches Q1 and Q2 are arranged in a half-bridge configuration. Switch Q1 is connected to a bulk DC voltage at V_rail, which may be provided by a conventional rectifier and/or conventional power factor correction circuit (not shown) that are well-known to those skilled in the art. The gates of inverter switches Q1 and Q2 are connected to a conventional inverter drive circuit (not shown but also well known to those of skill in the art) to cause the inverter circuit to generate a high frequency inverter output voltage. Capacitor C_dc_block is a DC blocking capacitor that AC couples the inverter output voltage to a first end of a resonant inductor L_resonant. The second end of resonant inductor L_resonant is connected to a first end of a resonant capacitor C_resonant. The second end of resonant capacitor C_resonant is connected to a circuit ground or common node. Resonant capacitor C_resonant and resonant inductor L_resonant are part of a resonant inverter tank circuit.

Series-connected gas discharge lamps Lamp_1 and Lamp_2 are connected across a first lamp terminal or first ballast output terminal defined by the connection node between the resonant inductor L_resonant and the resonant capacitor C_resonant, and a second lamp terminal or second ballast output terminal defined by the circuit ground or common node.

The preheat circuit of the present invention can further include a resonant preheat tank circuit. In the embodiment of FIG. 3, a primary winding T_preheat of a filament transformer is connected in parallel with a preheat capacitor C_preheat, forming a resonant preheat tank circuit. Windings T_preheat_A, T_preheat_B and T_preheat_C are secondary windings magnetically coupled to primary winding T_preheat. The first secondary winding T_preheat_A is electrically coupled to the first lamp terminal and, in this embodiment, directly across the first filament R_filament_1*a* of first lamp Lamp_1. The second secondary winding T_preheat_C is electrically coupled to the second lamp terminal and, in this embodiment, directly across second filament R_filament_2*ab* of second lamp Lamp_2.

Because the embodiment of FIG. 3 is configured for use with two gas discharge lamps connected in series, the second filament R_filament_1*b* of first lamp Lamp_1 is connected in series with the first filament R_filament_2*a* of the second lamp Lamp_2. This can be implemented by series connection in a lamp fixture. A third secondary winding T_preheat_B is, in this embodiment, directly connected across the series-connected filaments R_filament_1*b* and R_filament_2*a* at a third lamp terminal or third ballast output terminal.

Figure 1:
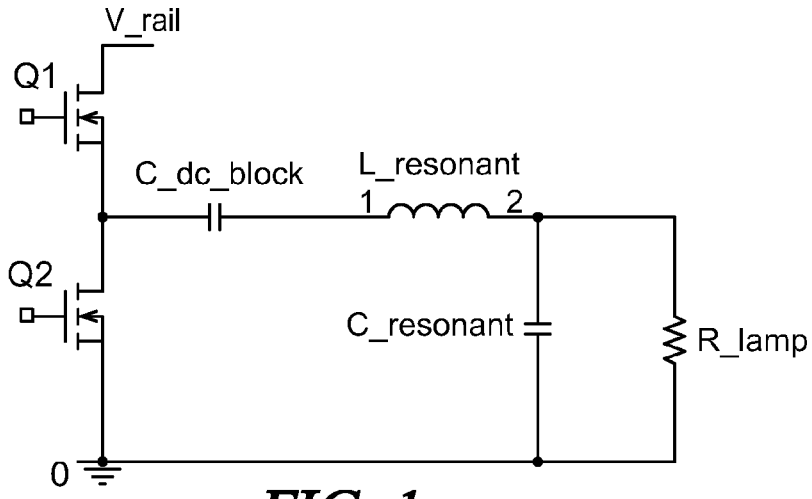
FIG. 1 (PRIOR ART)
FIG. 1 is a schematic diagram of conventional half-bridge inverter circuit used in an electronic ballast.
Figure 2:
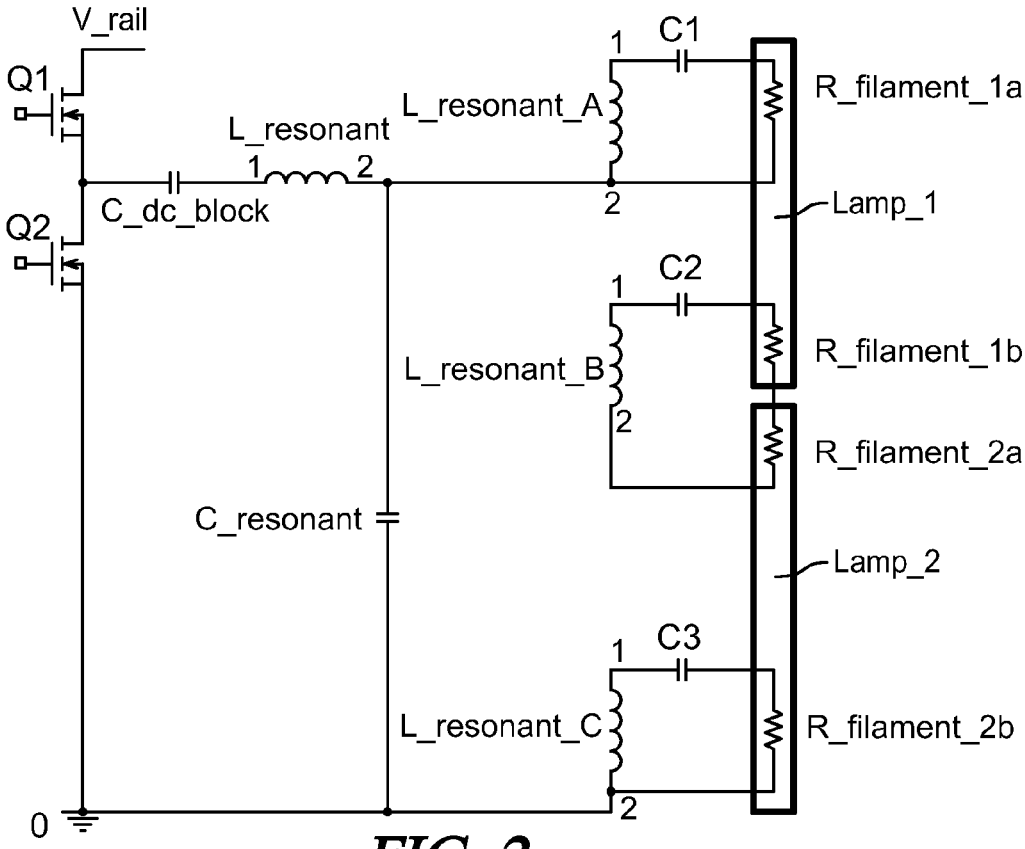
FIG. 2 (PRIOR ART)
FIG. 2 is a schematic diagram of a conventional lamp filament preheating circuit used in a program-start electronic ballast.

In other words, a series-connected lamp pair Lamp_1 and Lamp_2 in FIG. 3 will have a first pair of lamp filament terminals (corresponding to filament R_filament_1*a*) that are directly connected across the first secondary winding T_preheat_A, a second pair of lamp filament terminals (corresponding to filament R_filament_2*b*) that are directly connected across the second secondary winding T_preheat_C, and third pair of lamp filament terminals (corresponding to filaments R_filament_1*b* and R_filament_2*a*) that are directly connected across the third secondary winding T_preheat_B. In this embodiment, "directly connected" can mean that no additional components (such as capacitors C1, C2, and C3 shown in FIG. 2) are needed in the filament preheat circuit to limit the filament voltage during steady-state operation.

Thus, preheat capacitor C_preheat and primary winding T_preheat form a parallel-resonant preheat tank circuit that is used to preheat the filaments of Lamp_1 and Lamp_2 by coupling the preheat voltage developed across the preheat tank circuit to the lamp filaments using the secondary windings. As described below, the preheat tank circuit will also help cut back the lamp filament voltage during steady state operation.

A first circuit junction of the preheat tank circuit is connected to the connection node between the resonant inductor L_resonant and resonant capacitor C_resonant. A second circuit junction of the preheat tank circuit is connected to a first terminal of cut-back capacitor C_cut_back. The second terminal of cut-back capacitor C_cut_back is connected to the second lamp terminal (circuit ground or common node).

It can be seen that during steady-state operation, cut-back capacitor C_cut_back is also effectively part of the resonant inverter tank circuit that includes resonant inductor L_resonant and resonant capacitor C_resonant. The cut-back capacitor C_cut_back helps limit the steady-state current through the preheat tank circuit (preheat capacitor C_preheat and primary winding T_preheat of a filament transformer).

Referring again to FIG. 3, the operation of the preheat circuit of the present invention can be described. A preheat frequency f_preheat and steady-state working frequency f_steady are first selected during design of the circuit. If the natural resonant frequency of the preheat tank circuit (capacitor C_preheat and winding T_preheat) is designed to be the same as the preheat frequency f_preheat, the equivalent impedance of the preheat tank circuit will be very high because the preheat tank circuit will be in a resonant state during the preheat mode. As a result, most of the inverter output voltage across the resonant capacitor C_resonant will be present across the preheat tank circuit (capacitor C_preheat and winding T_preheat). This voltage will provide a suitable preheat filament voltage for the lamps Lamp_1 and Lamp_2.

Because cut-back capacitor C_cut_back is part of the series-resonant inverter tank circuit during steady-state operation, the capacitance of resonant capacitor C_resonant can be chosen to be relatively low. This, in turn, will reduce the current through resonant inductor L_resonant during lamp preheating and lamp starting. This low current will also help reduce the physical size of the resonant inductor L_resonant. Also, the lower current will eliminate the need to use current-limiting capacitors C1, C2 and C3 as shown in the prior art circuit of FIG. 2. With current-limiting capacitors C1, C2 and C3 not in the circuit, the lamp pin currents will be naturally balanced.

After the lamps Lamp_1 and Lamp_2 are ignited, the ballast is operating in a steady-state mode with a steady-state frequency f_steady. Typically, the steady-state frequency f_steady is much lower than the preheat frequency f_preheat. Therefore, during steady-state operation, the equivalent impedance of the preheat tank circuit (capacitor C_preheat and winding T_preheat) is relatively low because the steady-state frequency f_steady is much lower than the natural resonant frequency (f_preheat) of the preheat tank circuit. Furthermore, the cut-back capacitor C_cut_back will limit the current through the preheat tank circuit. If the capacitance of cut-back capacitor C_cut_back is chosen to be small, the steady state voltage across the preheat circuit tank will be very low, which will result in a very low filament voltage during steady-state operation of the lamp and ballast.

One example of a design of a lamp preheat circuit for a program-start ballast in accordance with the present invention is described below. In this embodiment, the circuit is designed to power two T5 28 watt lamps connected in series between first and second lamp terminals. The lamp filaments (R_filament_1*b* and R_filament_2*a* in FIG. 3) are also connected in series at a third lamp terminal.

The preheat frequency f_preheat is selected to be 100 kHz. The steady state frequency f_steady is selected to be 58 kHz. The nominal lamp current is 170 mA. The preheat capacitor C_preheat is selected to have a capacitance of 22 nF, with a primary winding T_preheat inductance of 15 uH so that the natural resonant frequency of the preheat tank circuit is:

$$\frac{1}{2\pi\cdot\sqrt{C_{preheat}\cdot \text{T_preheat}}} = 100\ \text{KHz}.$$

The turns ratio between the primary winding T_preheat and the secondary windings are:

N_T_preheat/N_T_preheat_A=12.6

N_T_preheat/N_T_preheat_B=6.8

N_T_preheat/N_T_preheat_C=12.6

Finally, the other component values are:

DC blocking capacitor C_dc_block=100 nF

Resonant inductor L_resonant=3.2 mH

Resonant capacitor C_resonant=1.2 nF

Cut-back capacitor C_cut_back=0.56 nF

If a 470 DC voltage is obtained from a power factor correction circuit and applied at V_rail, and by using the design parameters summarized above, the preheat circuit as shown above will provide a preheat filament voltage of approximately 8 volts during lamp preheating and a steady-state filament voltage of approximately 0.3 volts on all lamp filaments during steady-state operation.

Thus, although there have been described particular embodiments of the present invention of a new and useful lamp preheat circuit for an electronic ballast with filament voltage cut-back in steady-state, it is not intended that such references be construed as limitations upon the scope of this invention except as set forth in the following claims.

What is claimed is:

1. A circuit for preheating filaments in lamps powered by an electronic ballast, the ballast having an inverter providing an inverter output voltage at an inverter output, the circuit comprising:

an inverter tank circuit comprising a resonant inductor coupled at a first end to the inverter output and at a second end to a first lamp terminal and a resonant capacitor coupled between the first lamp terminal and a second lamp terminal;

a preheat tank circuit comprising a preheat capacitor connected in parallel with a primary winding of a filament transformer, the preheat tank circuit having a first circuit junction and a second circuit junction, the first circuit junction coupled to the first lamp terminal;

a cut-back capacitor connected between the second circuit junction of the preheat tank circuit and the second lamp terminal;

the filament transformer having a first secondary winding coupled to the first lamp terminal and a second secondary winding coupled to the second lamp terminal to provide a lamp filament current at each terminal;

the inverter is functional to operate at a preheat frequency during a lamp preheat mode and at a steady-state frequency during a lamp steady-state mode, the steady-state frequency being lower than the preheat frequency; and the preheat tank circuit has a natural resonant frequency that is approximately the same as the preheat frequency so that when the ballast is operating in the steady state mode, a filament voltage will be substantially lower than when the ballast is operating in the preheat mode.

2. The circuit of claim 1, the filament transformer further comprising a third secondary winding coupled to a third lamp terminal.

3. The circuit of claim 1 wherein the capacitance values of the resonant capacitor and the cut-back capacitor are respectively selected to limit the lamp filament currents in the circuit without the use of additional current limiting components.

4. A ballast circuit for powering a gas discharge lamp comprising:

a first and second ballast output terminal;

an inverter circuit functional to convert a DC rail voltage into a ballast output voltage across the ballast output terminals an inverter tank circuit electrically coupled to the inverter circuit and to the first and second ballast output terminals;

a preheat tank circuit electrically coupled to the first ballast output terminal;

a filament transformer having a primary winding and first and second secondary windings, the primary winding forming part of the preheat tank circuit and the first and second secondary windings electrically coupled to respective first and second ballast output terminals to provide a lamp filament current;

a cut-back capacitor electrically coupled between the preheat tank circuit and the second ballast output terminal;

the preheat tank circuit further comprising resonant circuit components defining a preheat tank resonant frequency;

the inverter circuit is further functional to provide the ballast output voltage at a preheat frequency during a lamp preheat mode and at a steady-state frequency during a lamp steady-state mode, the preheat frequency being different from the steady-state frequency; and wherein the preheat tank resonant frequency is closer to the preheat frequency than to the steady-state frequency so that when the inverter circuit is operating in the steady-state mode, a steady-state voltage developed across the primary winding in the preheat tank circuit is lower than a preheat voltage developed across the primary winding when the inverter circuit is operating in the preheat mode.

5. The ballast circuit of claim 4 wherein:

the inverter tank circuit comprises a resonant inductor connected in series with a resonant capacitor so that the first and second ballast output terminals are connected across the resonant capacitor;

the preheat tank circuit comprises a preheat capacitor connected in parallel with a the primary winding of the filament transformer so that preheat tank circuit and the cut-back capacitor form a series-connected circuit that is coupled across the resonant capacitor; and the resonant inductor, resonant capacitor, the preheat capacitor, the primary winding, and the cut-back capacitor have respective component values that are selected so that the preheat tank resonant frequency is substantially equal to the preheat frequency, the steady-state frequency is lower than the preheat frequency, when the inverter circuit is operating in the preheat mode, most of the ballast output voltage is present across the primary winding to provide a filament voltage across the secondary windings that is effective to preheat and start a gas discharge lamp, and when the inverter circuit is operating in the steady-state mode, the filament voltage is substantially lower than when the inverter circuit is operating in the preheat mode.

6. The ballast circuit of claim 5 wherein the respective component values for the resonant inductor, resonant capacitor, the preheat capacitor, the primary winding, and the cut-back capacitor are further selected so that no additional circuit components are needed to reduce the filament voltage during steady-state operation.

7. The ballast circuit of claim 5, further comprising at least one gas discharge lamp connected to the first and second ballast output terminals, the at least one discharge lamp having a first pair of lamp filament terminals that are directly connected across the first secondary winding and a second pair of lamp filament terminals that are directly connected across the second secondary winding.

8. The ballast circuit of claim 7, further comprising:

the filament transformer comprising a third secondary winding coupled to a third ballast output terminal; and a first and second gas discharge lamp series connected at the third ballast output terminal between the first and second ballast output terminals and having a third pair of filament terminals directly connected across the third secondary winding.

* * * * *